US010681984B1

(12) United States Patent
Lin

(10) Patent No.: US 10,681,984 B1
(45) Date of Patent: Jun. 16, 2020

(54) SEATING DEVICE OF A FOLDABLE CHAIR

(71) Applicant: Spec Seats Technologies Inc., Taoyuan (TW)

(72) Inventor: Mei Chuen Lin, Taoyuan (TW)

(73) Assignee: Spec Seats Technologies Inc., Taoyuan (TW)

( * ) Notice: Subject to any disclaimer, the term of this patent is extended or adjusted under 35 U.S.C. 154(b) by 0 days.

(21) Appl. No.: 16/282,168

(22) Filed: Feb. 21, 2019

(51) Int. Cl.

| | |
|---|---|
| ***A47C 7/24*** | (2006.01) |
| ***A47C 7/26*** | (2006.01) |
| ***A47C 4/02*** | (2006.01) |
| ***A47C 7/18*** | (2006.01) |
| ***A47C 4/06*** | (2006.01) |
| ***A47C 4/14*** | (2006.01) |
| ***A47C 7/16*** | (2006.01) |
| ***A47C 7/40*** | (2006.01) |

(52) U.S. Cl.
CPC ..... *A47C 4/14* (2013.01); *A47C 4/028* (2013.01); *A47C 4/06* (2013.01); *A47C 7/16* (2013.01); *A47C 7/185* (2013.01); *A47C 7/24* (2013.01); *A47C 7/26* (2013.01); *A47C 7/40* (2013.01)

(58) Field of Classification Search
CPC .. A47C 4/028; A47C 7/28; A47C 7/26; A47C 4/06; A47C 7/185
See application file for complete search history.

(56) References Cited

U.S. PATENT DOCUMENTS

| | | | | | |
|---|---|---|---|---|---|
| 2,750,996 | A * | 6/1956 | Cramer | A47C 7/185 | 267/145 |
| 3,275,375 | A * | 9/1966 | Moore | A47C 7/185 | 297/445.1 |
| 3,295,891 | A * | 1/1967 | Brown | A47C 7/185 | 297/452.65 |
| 3,301,597 | A * | 1/1967 | Bereday | A47C 4/028 | 297/450.1 |
| 3,528,096 | A * | 9/1970 | Moberg | A47C 11/005 | 297/130 |
| 3,556,594 | A * | 1/1971 | Anderson | A47C 4/02 | 297/452.59 |
| 3,708,202 | A * | 1/1973 | Barecki | A47C 1/124 | 297/239 |
| 3,823,980 | A * | 7/1974 | Harnick | A47C 3/12 | 297/452.14 |

(Continued)

FOREIGN PATENT DOCUMENTS

WO WO-2011130201 A1 * 10/2011 ..... A47C 4/02

*Primary Examiner* — Timothy J Brindley
(74) *Attorney, Agent, or Firm* — Wang Law Firm, Inc.

(57) ABSTRACT

The present invention provides a seating device of a foldable chair. The seating device includes a backrest and a seating portion. The backrest includes a backrest rigid plate, a plurality of backrest rivets and a backrest cushion. A plurality of joining portions are formed at the rear end of each of the backrest rivets via a press molding process. The backrest cushion is disposed on the first side of the composite board. The plywood is mounted to the second side of the composite board by screws. The seating portion includes a seating portion rigid plate, a plurality of seating portion tapped holes and a seating portion cushion. The seating portion cushion is disposed on the first side of the seating portion rigid plate. The chair frame is mounted on the second side of the seating portion rigid plate by screws.

9 Claims, 8 Drawing Sheets

(56) References Cited

U.S. PATENT DOCUMENTS

| | | | | | |
|---|---|---|---|---|---|
| 3,825,302 | A * | 7/1974 | Kurtz | A47C 4/02 | 297/440.22 |
| 4,067,073 | A * | 1/1978 | Komarov | A47C 4/028 | 5/13 |
| 5,378,040 | A * | 1/1995 | Chaney | A47C 1/022 | 297/338 |
| 5,649,742 | A * | 7/1997 | Liu | A47C 3/00 | 297/440.22 |
| 6,935,698 | B1 * | 8/2005 | Chen | A47C 4/02 | 297/440.22 |
| 2005/0017554 | A1 * | 1/2005 | Mizelle | A47C 4/06 | 297/218.3 |
| 2005/0151409 | A1 * | 7/2005 | Infanti | A47C 4/02 | 297/440.2 |
| 2011/0084537 | A1 * | 4/2011 | Lin | A47C 4/24 | 297/452.18 |
| 2018/0070729 | A1 * | 3/2018 | Tseng | A47C 7/26 | |

* cited by examiner

SEATING DEVICE OF A FOLDABLE CHAIR

BACKGROUND OF THE INVENTION

1. Field of the Invention

The present invention relates generally to a seating device of a foldable chair, more particularly, relates to a seating device of a foldable chair that can prevent water permeation.

2. The Prior Arts

Foldable chairs are a type of chair that can be folded for storage. When a foldable chair is not in use, it can be folded to decrease its footprint so as to facilitate easy storage and transportation. Such foldable chairs are widely used in various outdoor or indoor occasions.

A conventional foldable chair includes: a front stand with an arced shape, a back rest, a seating portion and a rear stand. The seating portion includes a chair frame. A pivotal connecting member is provided on each of the two sides of the chair frame. The front stand is pivotally connected to the pivotal connecting member and the rear stand. The backrest is disposed at the arced portion of the front stand. Via the pivotal connection between the front stand and chair frame and the pivotal connection between the front stand and the rear stand, the seating portion and the rear stand are made rotatable and foldable for storage purpose.

When a foldable chair is used in outdoor occasions, it is often exposed to wind and rainwater. Herein, when mounting the backrest and the seating portion of a conventional foldable chair, rivets are directly mounted through the rigid plates of the backrest and the seating portion; subsequently, screws are used to mount the backrest and the seating portion to the front stand.

However, when the rivets are directly mounted through the rigid plates, the edge of the rivets are often not in close contact with the rigid plates, thereby leaving a gap between the two. When the foldable chair is exposed in the rain, rainwater would leak into the gaps between the rivets and the rigid plates, causing the foam above the rigid plates to deform and corrode due to dampness. The foam in the backrest is also subject to dampness and may also become corroded. Hence, the lifetime of foldable chair is shortened. Due to the above reason, there is a need in the industry to improve the structure thereof.

SUMMARY OF THE INVENTION

Due to the foregoing reasons, a primary objective of the present invention is to provide a seating device of a foldable chair that does not have any gap between its components. In such a way, rainwater is kept from permeating into the chair, thereby preventing the backrest and seating portion from deformation and corrosion.

For achieving the foregoing objectives, the present invention provides a seating device of a foldable chair. The seating device is disposed on a chair. The chair comprises a front stand, a chair frame and a rear stand. A pivotal connecting member is respectively disposed at two sides of the chair frame. The pivotal connecting member and the rear stand are pivotally connected to the front stand, respectively. The seating device of the foldable chair includes a backrest and a seating portion.

The backrest is disposed on the front stand. Herein, the backrest comprises a backrest rigid plate, a plurality of backrest rivets and a backrest cushion. The backrest rigid plate comprises a plywood and a composite board. The composite board has a first side, a second side and a plurality of composite board positioning holes. The plywood has a plurality of plywood positioning holes. Each of the backrest rivets has a body, a front end and a rear end. The body of each of the backrest rivets are disposed in each of the composite board positioning holes. The front end of each of the backrest rivets is fitted against the first side of the composite board. A plurality of joining portions are formed at the rear end of each of the backrest rivets via a press molding process. The joining portions are fitted against the second side of the composite board. The backrest cushion is disposed on the first side of the composite board. A plurality of screws are positioned through the plywood positioning holes and are mounted to the composite board positioning holes of the composite board, thereby mounting the plywood to the second side of the composite board.

The seating portion is disposed on the chair frame. Herein, the seating portion comprises a seating portion rigid plate, a plurality of seating portion tapped holes and a seating portion cushion. The seating portion rigid plate has a first side and a second side. The seating portion tapped holes are integratedly formed on the seat plate rigid plate. End faces of two ends of each of the seating portion tapped holes are respectively aligned with surfaces of the first side and the second side of the seating portion rigid plate. The seating portion cushion is disposed on the first side of the seating portion. A plurality of screws are positioned through a plurality of chair frame positioning holes of the chair frame and are mounted to the seat portion tapped holes, thereby mounting the chair frame to the second side of the seat portion rigid plate.

In an embodiment of the present invention, a concaved surface is formed at a center of the seat portion rigid plate of the seating portion, and a plurality of ventilation holes are provided on the concaved surface.

In an embodiment of the present invention, the backrest cushion comprises a backrest foam and a backrest leather, the backrest leather is configured to enclose the backrest foam and the backrest rigid plate.

In an embodiment of the present invention, the seating portion cushion comprises a seating portion foam, a seating portion leather and a noise cancelling foam. The seating portion leather is configured to enclose the seating portion foam and the seating portion rigid plate, and the noise cancelling foam is disposed between the seating portion rigid plate and the seating portion foam.

In an embodiment of the present invention, the composite board is made of wood.

In an embodiment of the present invention, a number and positions of the plywood positioning holes corresponds to a number and positions of the composite board positioning holes.

In an embodiment of the present invention, a number and positions of chair frame positioning holes corresponds to a number and positions of the seating portion tapped holes.

In an embodiment of the present invention, the seating portion rigid plate further comprises a plurality of ribs, the ribs are provided on the seating portion rigid plate and are configured to surround a center of a concaved surface of the seating portion rigid plate with equal angles therebetween. Herein, each of the ribs has an abutting portion.

The present invention is advantageous in that no gap is present between the components of the chair. Specifically, the backrest rivets are mounted to the composite board positioning holes, which are pre-formed on the composite boards, so that the joining portions are fitted against the second side of the composite board without any gaps therebetween. In addition, by integratedly forming the seating portion tapped holes on the seating portion rigid plate via an injection molding process, gaps are further prevented from forming between the components of the foldable chair. In such a way, the problem of the edge of rivets not being in close contact with the rigid plates in conventional foldable chairs can be overcome. Thus, rainwater is kept from permeating into the chair, and the backrest and seating portion are also prevented from being deformed and corroded.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
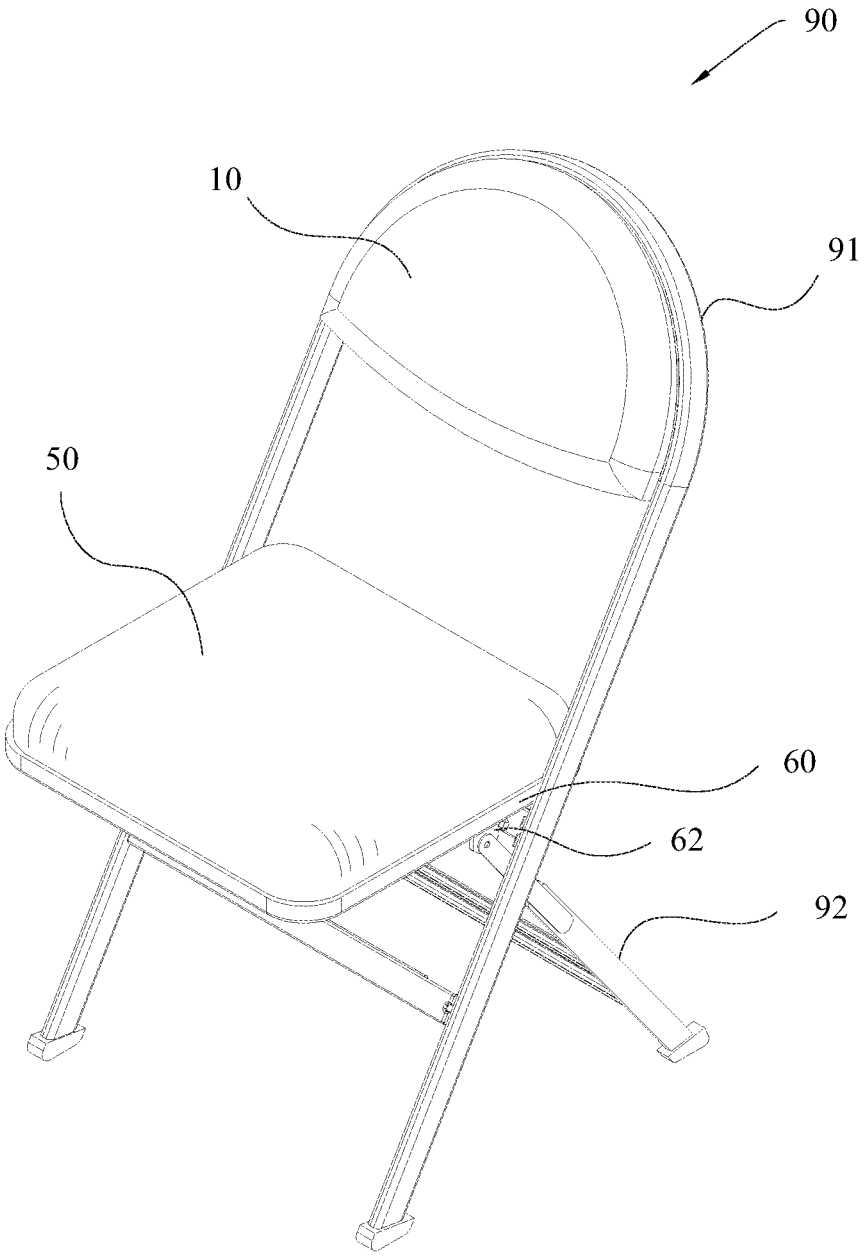
FIG. 1 is a perspective view illustrating a preferred embodiment of the present invention.

FIG. 1 is a perspective view illustrating a preferred embodiment of the present invention. As shown in FIG. 1, a seating device of a foldable chair is provided by the present invention. The seating device is disposed on a chair 90. The chair 90 includes a front stand 91, a chair frame 60 and a rear stand 92. The front stand 91 has an arced shape. A pivotal connecting member 62 is respectively disposed at two sides of the chair frame 60. The pivotal connecting member 62 and the rear stand 92 are pivotally connected to the front stand 91, respectively. Via the pivotal connection between the front stand 91 and chair frame 60 and the pivotal connection between the front stand 91 and the rear stand 92, the chair frame 60 and the rear stand 92 are made rotatable and foldable for storage purpose.

The seating device of the foldable chair of the present invention includes a backrest 10 and a seating portion 50.

Figure 2:
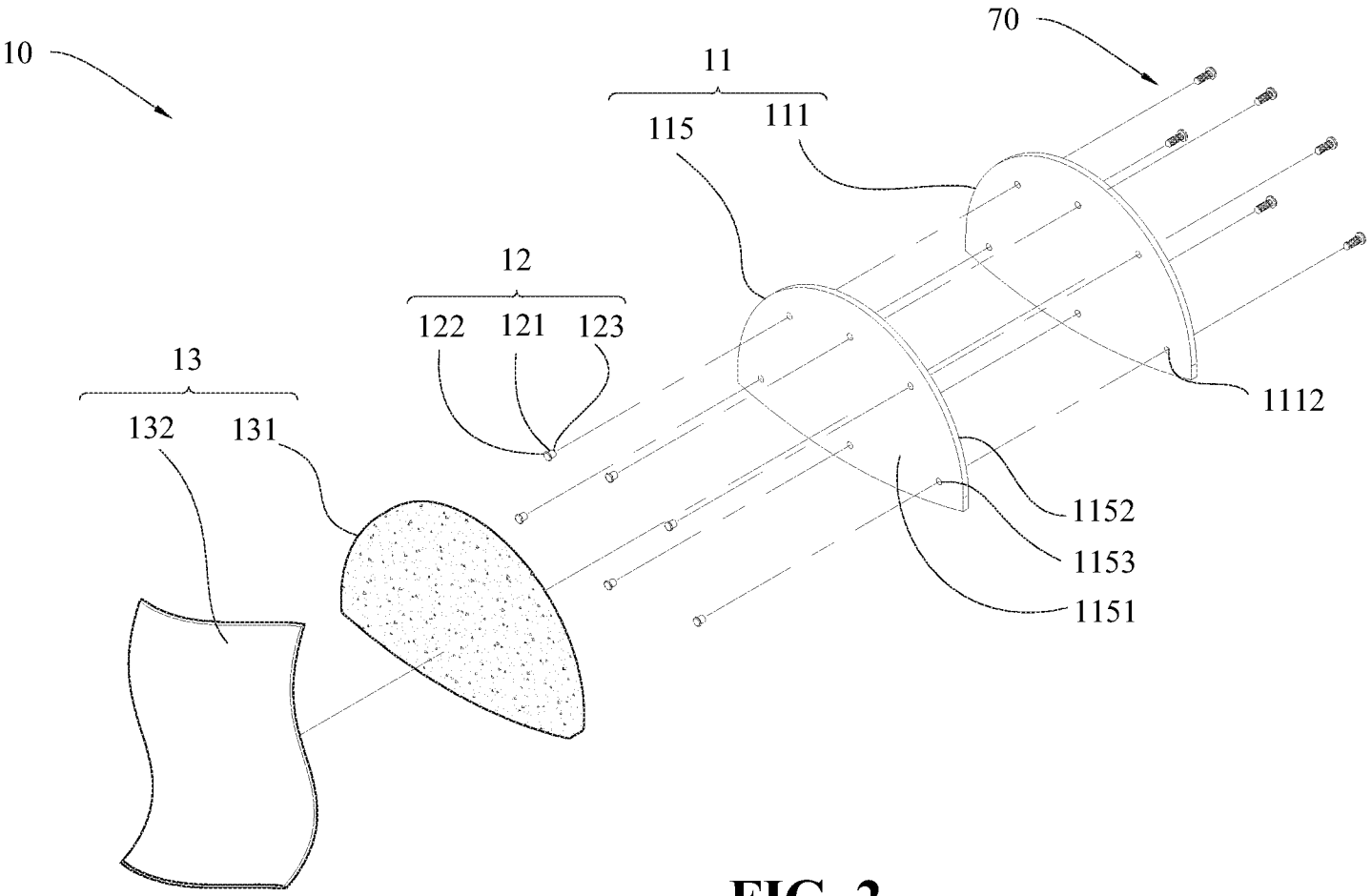
FIG. 2 is an exploded and perspective view of a backrest according to the preferred embodiment of the present invention.

FIG. 2 is an exploded and perspective view illustrating the backrest according to the preferred embodiment of the present invention. As shown in FIG. 2, the backrest 10 is disposed at the arced portion of the front stand 91. The backrest 10 includes a backrest rigid plate 11, a plurality of backrest rivets 12 and a backrest cushion 13. The backrest rigid plate 11 comprises a plywood 111 and a composite board 115. The plywood 111 has a plurality of plywood positioning holes 1112. The composite board 115 has a first side 1151, a second side 1152 and a plurality of composite board positioning holes 1153. The number and positions of the plywood positioning holes 1112 are configured to correspond to the number and positions of the composite board positioning holes 1153. In the preferred embodiment of the present invention, the composite board 115 of the backrest 10 is a wood board with appropriate thickness.

The backrest cushion 13 is disposed on a first side 1151 of the composite board 115. The backrest cushion 13 includes a backrest foam 131 with a certain thickness and a backrest leather 132. The backrest leather 132 is configured to tightly enclose the backrest foam 131 and the backrest rigid plate 11. Herein, the backrest leather 132 merely encloses the backrest rigid plate 11 to the edge thereof. The backrest leather 132 is fixed to the backrest rigid plate 11 via adhesion, staples (not shown), rivets (not shown) or other conventional securing means.

Figure 3:
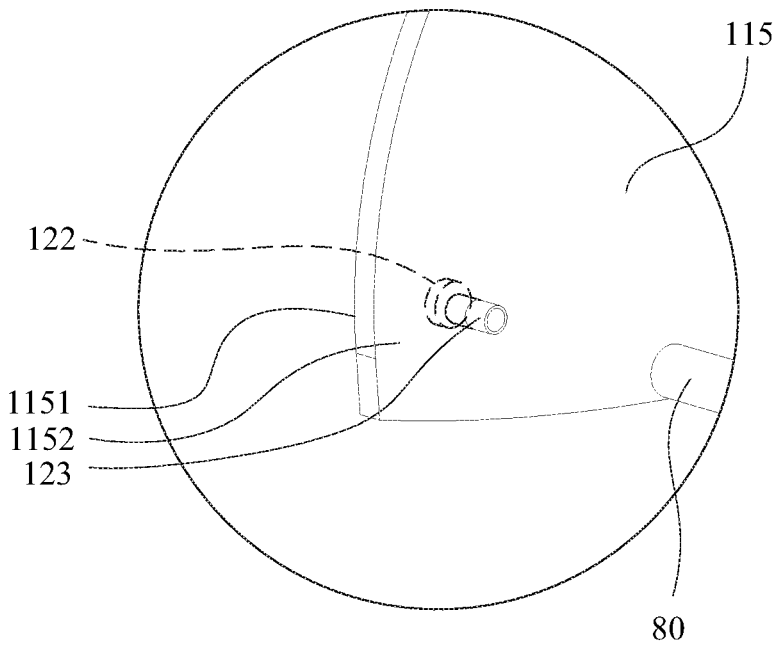
FIGS. 3, 4 and 5 are schematic views illustrating press molding process of the joining portions of the backrest rivets according to the preferred embodiments of the present invention.
Figure 4:
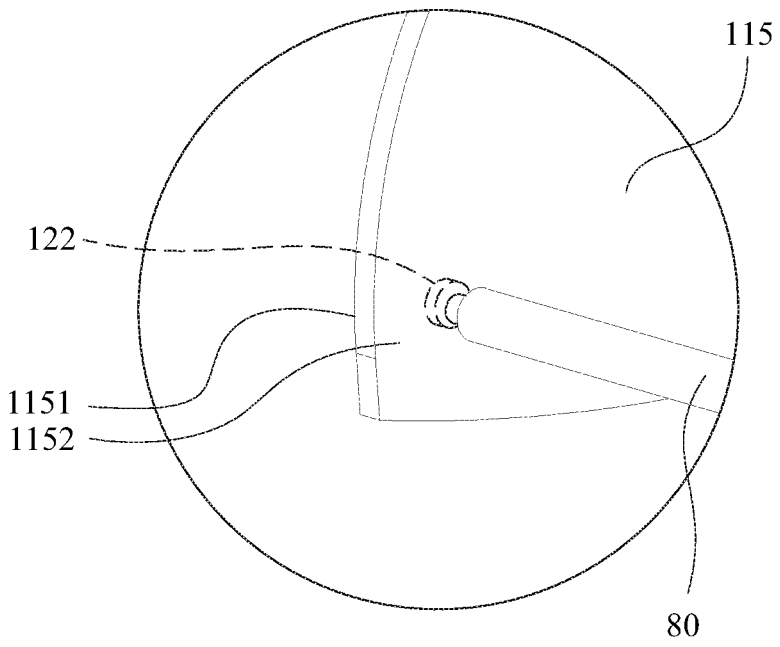
Figure 5:
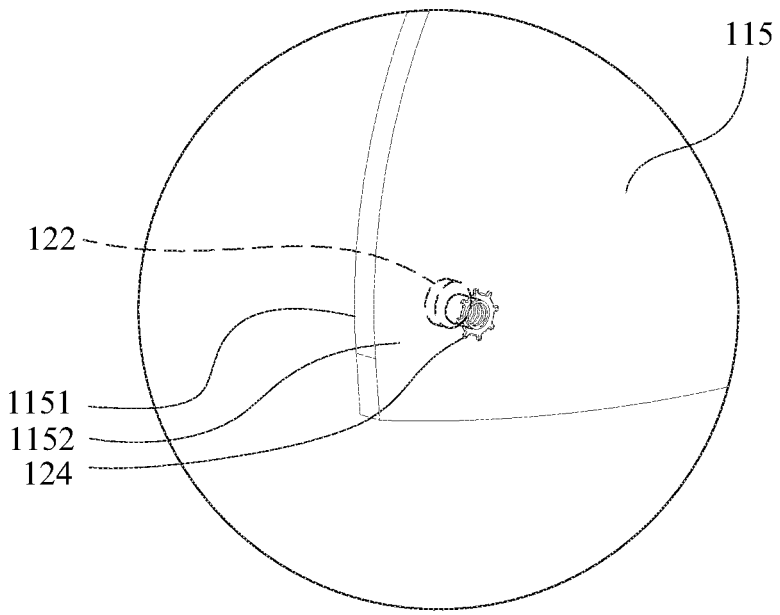

FIGS. 3, 4 and 5 are schematic views illustrating the press molding process of the joining portions of the backrest rivets according to the preferred embodiments of the present invention. FIGS. 3, 4 and 5 are viewed together with FIG. 2. As shown in FIG. 2, the backrest rivets 12 includes a body 121, a front end 122 and a rear end 123. As shown in FIG. 3, when mounting the backrest rivets 12, the body 121 of each of the backrest rivets 12 are positioned into the composite board positioning holes 1153 respectively such that the front end 122 of each of the backrest rivets 12 are fitted against the first side 1151 of the composite board 115 without any gaps formed therebetween. As shown in FIGS. 4 and 5, joining portions 124 are formed at the rear end 123 of each of the backrest rivets 12 via a press molding process. The joining portions 124 are fitted against the second side 1152 of the composite board 115 without any gaps formed therebetween. In such a way, rainwater is kept from permeating into the chair, and the backrest and seating portion are also prevented from being deformed and corroded.

Multiple screws 70 are respectively positioned through the plywood positioning holes 1112 and are screwed into to the composite positioning holes 1153, thereby mounting the plywood 111 to the second side 1152 of the composite board 115.

Figure 6:
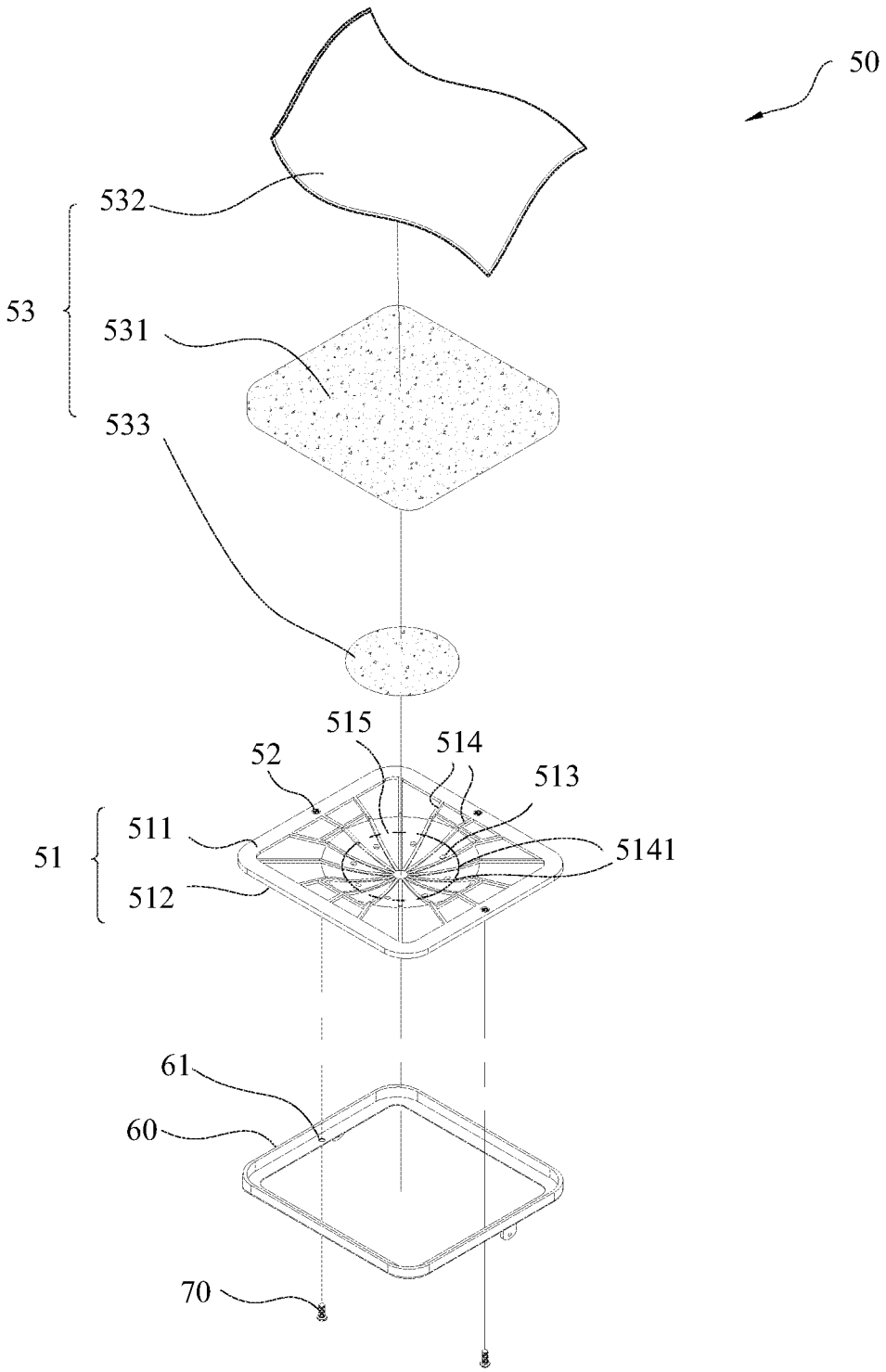
FIG. 6 is an exploded and perspective view illustrating a seating portion according to the preferred embodiment of the present invention.

FIG. 6 is an exploded and perspective view of the seating portion according to the preferred embodiment of the present invention. As shown in FIG. 6, the seating portion 50 is disposed on the chair frame 60. The seating portion 50 includes a seating portion rigid plate 51, a plurality of seating portion tapped holes 52 and a seating portion cushion 53. The seating portion rigid plate 51 has a first side 511, a second side 512 and a plurality of ventilation holes 513. In the preferred embodiment of the present invention, a concaved surface is formed at a center of the seat portion rigid plate 151, and the ventilation holes 513 are provided on the concaved surface. With the concaved surface at the center of the seat portion rigid plate 51, the comfort of the chair may be enhanced. Furthermore, when the seating portion 50 is exposed in the rain, rainwater can be concentrated at the concaved surface and can be discharged through the ventilation holes 513.

Figure 7:
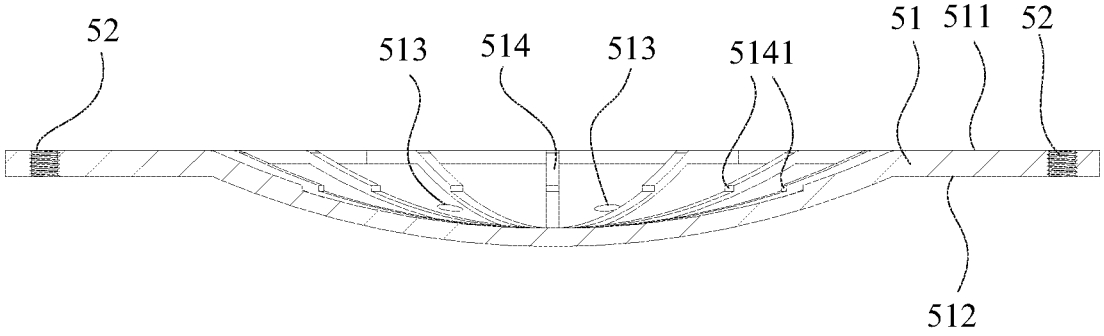
FIG. 7 is a cross-sectional side view illustrating a seating portion rigid plate according to the preferred embodiment of the present invention.
Figure 8:
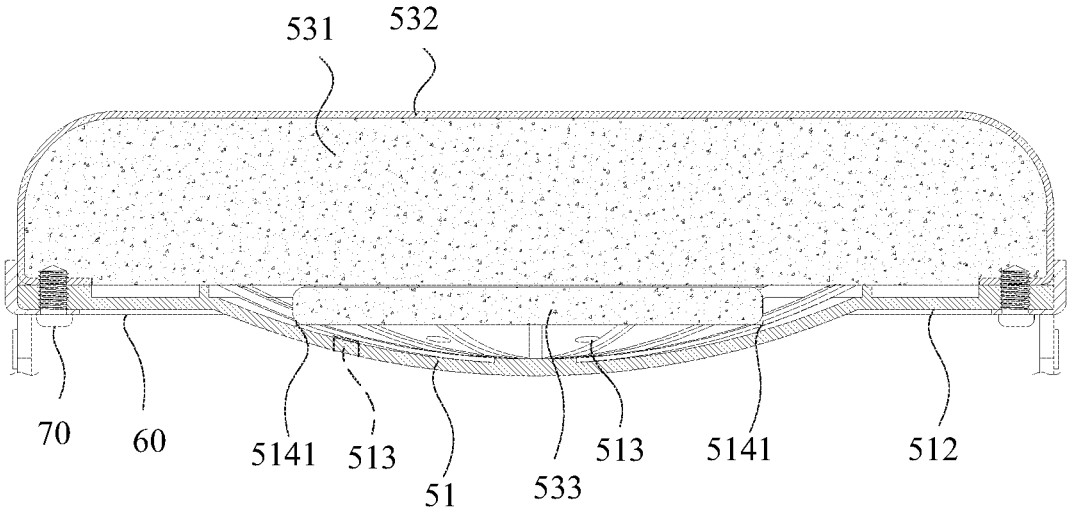
FIG. 8 is a cross-sectional side view illustrating the seating portion according to the preferred embodiment of the present invention.

FIG. 6 is an exploded and perspective view of the seating portion according to the preferred embodiment of the present invention. FIG. 7 is the cross-sectional side view of the seating portion rigid plate according to the preferred embodiment of the present invention. FIG. 8 is a cross-sectional side view illustrating the seating portion according to the preferred embodiment of the present invention. As shown in FIGS. 6, 7 and 8, the seating portion tapped holes 52 are embedded elements. Specifically, the seating portion tapped holes 52 are formed in the seating portion rigid plate 51 via the injection molding process. Herein, the end faces of the two ends of the seating portion tapped holes 52 are respectively aligned with the first side 511 and the second side 512 of the seating portion rigid plate 51. In the preferred embodiment of the present invention, the seating portion rigid plate 51 is a plastic board formed by injection molding process.

The seating portion cushion 53 is disposed on the first side 511 of the seating portion rigid plate 51. The seating portion cushion 53 includes a seating portion foam 531, a seating portion leather 532 and a noise cancelling foam 533. The seating portion leather 532 is configured to tightly and closely enclose the seating portion form 531 and the seating portion rigid plate 51. The noise cancelling foam 533 is disposed between the seating portion rigid plate and the seating portion foam 531. Herein, the seating portion leather 532 only encloses the seating portion rigid plate 51 until the edge thereof. The seating portion leather 531 is fixed to the seating portion rigid plate 51 via adhesion, staples (not shown), rivets (not shown) or other conventional securing means.

Herein, in the preferred embodiment of the present invention, the seating portion rigid plate 51 further includes a plurality of ribs 514. The ribs 514 are provided on the seating portion rigid plate 51 and are configured to surround a center of a concaved surface of the seating portion rigid plate 51 with equal angles therebetween. Herein, each of the ribs 514 has an abutting portion 5141. Each of the abutting portions 5141 are respectively disposed on the seating portion rigid plate 51. By arranging the ribs 514 on the seating portion rigid plate 51 to surround a center of a concaved surface of the seating portion rigid plate 51 with equal angles therebetween, a circular recess 515 is formed by the engaging portions 5141. The inner contour of the circular recess 515 is larger than the outer contour of the noise cancelling foam 533 such that the noise cancelling foam 533 can be fitted into the circular recess 515.

When the noise cancelling foam 533 is disposed on the seating portion rigid plate 51, the noise cancelling foam 533 can be positioned at the center of the concaved surface of the seating portion rigid plate 51 by the circular recess 515 formed by the engaging portion 5141, thereby fixing the noise cancelling foam 533 in place. In addition, when a user is sitting on the seating portion cushion 53, the air in the seating portion foam 531 and the noise cancelling foam 533 is squeezed out and discharged from the ventilation holes on the seating portion rigid plate 51.

When assembling the seating portion 50 and the chair frame 60, the screws 70 are respectively positioned through the chair frame positioning holes 61 of the chair frame 60 and are screwed into the seating portion tapped holes 52 on the seating portion rigid plate 51, thereby fixing the chair frame 60 to the second side 512 of the seating portion rigid plate 51. Herein, because the end faces of the two ends of the seating portion tapped holes 52 are respectively aligned with the first side 511 and the second side 512 of the seating portion rigid plate 51, the chair frame 60 can be tightly fitted against the seating portion rigid plate 51 without any gaps formed therebetween. In such a way, rainwater is kept from permeating into the chair, and the backrest and seating portion are also prevented from being deformed and corroded.

In the preferred embodiment of the present invention, the number and positions of the chair frame positioning holes 61 are configured to correspond to the number and positions of the seating portion tapped holes 52.

It is worth mentioning that the rivets and screws in the preferred embodiment of the present invention are made from anti-corrosion alloy. However, the material of the rivets and screws are not limited thereto.

In short, by mounting the backrest rivets 12 in the composite board positioning holes 1153 that are pre-formed on the composite board 115, and further by configuring the joining portions 124 such that they are tightly fitted against the second side 1152 of the composite board 115, gaps are prevented from forming between the components.

By integratedly forming the seating portion tapped holes 52 on the seating portion rigid plate 51 via an injection molding process, gaps are prevented from forming between the components of the foldable chair. In such a way, the problem of the edge of rivets not being in close contact with the rigid plates in conventional foldable chairs can be overcome. Thus, rainwater is kept from permeating into the chair, and the backrest and seating portion are also prevented from being deformed and corroded.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A seating device of a foldable chair, wherein the seating device is disposed on a chair, the chair comprises a front stand, a chair frame and a rear stand, a pivotal connecting member is respectively disposed at two sides of the chair frame, the pivotal connecting member and the rear stand are pivotally connected to the front stand, respectively, wherein the seating device of the foldable chair comprises:

a backrest disposed on the front stand, wherein the backrest comprises a backrest rigid plate, a plurality of backrest rivets and a backrest cushion, the backrest rigid plate comprises a plywood and a composite board, the composite board has a first side, a second side and a plurality of composite board positioning holes, the plywood has a plurality of plywood positioning holes, each of the backrest rivets has a body, a front end and a rear end, the body of each of the backrest rivets are disposed in each of the composite board positioning holes, the front end of each of the backrest rivets is fitted against the first side of the composite board, a plurality of joining portions are formed at the rear end of each of the backrest rivets via a press molding process, the joining portions are fitted against the second side of the composite board, the backrest cushion is disposed on the first side of the composite board, a plurality of screws are positioned through the plywood positioning holes and are mounted to the composite board positioning holes of the composite board, thereby mounting the plywood to the second side of the composite board; and a seating portion disposed on the chair frame, wherein the seating portion comprises a seating portion rigid plate, a plurality of seating portion tapped holes and a seating portion cushion, the seating portion rigid plate has a first side and a second side, the seating portion tapped holes are integratedly formed on the seat plate rigid plate, end faces of two ends of each of the seating portion tapped holes are respectively aligned with surfaces of the first side and the second side of the seating portion rigid plate, the seating portion cushion is disposed on the first side of the seating portion, a plurality of screws are positioned through a plurality of chair frame positioning holes of the chair frame and are mounted to the seat portion tapped holes, thereby mounting the chair frame to the second side of the seat portion rigid plate.

2. The seating device according to claim 1, wherein a concaved surface is formed at a center of the seat portion rigid plate of the seating portion, and a plurality of ventilation holes are provided on the concaved surface.

3. The seating device according to claim 1, wherein the backrest cushion comprises a backrest foam and a backrest leather, the backrest leather is configured to enclose the backrest foam and the backrest rigid plate.

4. The seating device according to claim 1, wherein the seating portion cushion comprises a seating portion foam, a seating portion leather and a noise cancelling foam, the seating portion leather is configured to enclose the seating portion foam and the seating portion rigid plate, and the noise cancelling foam is disposed between the seating portion rigid plate and the seating portion foam.

5. The seating device according to claim 1, wherein the composite board is made of wood.

6. The seating device according to claim 1, wherein a number and positions of the plywood positioning holes corresponds to a number and positions of the composite board positioning holes.

7. The seating device according to claim 1, wherein a number and positions of chair frame positioning holes corresponds to a number and positions of the seating portion tapped holes.

8. The seating device according to claim 1, wherein the seating portion rigid plate further comprises a plurality of ribs, the ribs are provided on the seating portion rigid plate and are configured to surround a center of a concaved surface of the seating portion rigid plate with equal angles therebetween.

9. The seating device according to claim 8, wherein each of the ribs has an abutting portion.

* * * * *